US008069834B2

(12) United States Patent
Riedel et al.

(10) Patent No.: US 8,069,834 B2
(45) Date of Patent: Dec. 6, 2011

(54) ENGINE OIL LEVEL MANAGEMENT SYSTEM AND METHOD OF ASSEMBLING ENGINES IN VEHICLES

(75) Inventors: Paulo A. Riedel, Rochester Hills, MI (US); Manmeet S. Pannu, Sterling Heights, MI (US); Kendell Fulton, Fenton, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 672 days.

(21) Appl. No.: 12/188,459

(22) Filed: Aug. 8, 2008

(65) Prior Publication Data

US 2010/0031915 A1 Feb. 11, 2010

(51) Int. Cl.
*F01M 1/02* (2006.01)

(52) U.S. Cl. ..... 123/196 R; 123/196 A; 123/195 C; 184/106; 184/6.21; 184/6.24

(58) Field of Classification Search ..... 123/195 C, 123/196 R, 196 A, 198 DA, 1 R, 1 A; 180/69.1; 184/106, 6.21, 6.24
See application file for complete search history.

(56) References Cited

U.S. PATENT DOCUMENTS

| | | | | |
|---|---|---|---|---|
| 2,833,163 | A * | 5/1958 | Trombley | 475/310 |
| 2,938,601 | A * | 5/1960 | Brafford | 184/103.1 |
| 3,189,126 | A * | 6/1965 | May | 184/6.2 |
| 4,459,944 | A * | 7/1984 | Kirchweger et al. | 123/41.66 |
| 4,770,276 | A * | 9/1988 | Takubo | 184/106 |
| 4,901,814 | A * | 2/1990 | von Broock et al. | 180/297 |
| 4,938,184 | A | 7/1990 | Martin et al. | |
| 5,103,782 | A * | 4/1992 | Matsui | 123/195 C |
| 5,852,991 | A | 12/1998 | Yamamura et al. | |
| 5,960,763 | A | 10/1999 | Yamamura | |
| 6,250,274 | B1 * | 6/2001 | Deane | 123/196 R |
| 6,530,354 | B1 | 3/2003 | Bishop et al. | |
| 6,845,743 | B1 * | 1/2005 | Bishop | 123/195 C |
| 2004/0177827 | A1 * | 9/2004 | Hoyte et al. | 123/196 AB |

FOREIGN PATENT DOCUMENTS

| | | | |
|---|---|---|---|
| JP | 62-165016 | A * | 7/1987 |
| JP | 01026095 | A * | 1/1989 |
| KR | 20030032066 | A | 4/2003 |

* cited by examiner

*Primary Examiner* — Michael Cuff
*Assistant Examiner* — Hung Q Nguyen
(74) *Attorney, Agent, or Firm* — Quinn Law Group, PLLC

(57) ABSTRACT

An oil level management system for a vehicle has an oil pan configured to contain oil and to be mountable to an engine block with a baffle extending transverse to the axis of rotation of the engine crankshaft when the oil pan is so mounted. The baffle is configured to partially define a first oil reservoir and a second oil reservoir, as well as an oil flow opening such that the oil reservoirs are in fluid communication with one another and are characterized by respective first and second oil levels within the pan. The second reservoir drains to the first reservoir when the engine is running and when the engine block and crankshaft are positioned on the vehicle with the axis of rotation tilted from horizontal. The first oil level is lower than the second oil level to avoid oil contact with the crankshaft.

13 Claims, 5 Drawing Sheets

ENGINE OIL LEVEL MANAGEMENT SYSTEM AND METHOD OF ASSEMBLING ENGINES IN VEHICLES

TECHNICAL FIELD

The invention relates to an engine oil level management system, and specifically to an oil pan that is configured to manage oil level, as well as to a method of assembling engines in vehicles.

BACKGROUND OF THE INVENTION

A vehicle engine typically includes an oil pan that is mounted to the engine block. Oil is used to lubricate and cool the moving parts of the engine, including the crankshaft. The oil drains from the engine block into and collects in the oil pan before being pumped from the oil pan and recirculated through the engine again. If the moving parts contact the oil collected in the oil pan, the oil pressure decreases while the oil temperature increases, reducing oil life. Additionally, the oil becomes aerated, and is less efficient at cooling the engine. The oil contact also contributes to spin losses, reducing engine power.

In a front wheel-drive vehicle, the engine is typically installed with the axis of rotation of the crankshaft generally horizontal and transverse to the vehicle. In a rear wheel-drive vehicle, the engine is typically installed with the axis of rotation of the crankshaft running longitudinally, and tilted downward toward the rear of the vehicle so that the crankshaft may be appropriately connected to a longitudinally running drive shaft to drive the rear wheels. Since the oil pan is mounted below the crankshaft, the downward tilt could cause the rotating crankshaft to come into contact with the oil collected in the oil pan.

SUMMARY OF THE INVENTION

An oil level management system for a vehicle is provided with an oil pan having a unique configuration to manage the oil level to prevent contact with the rotating crankshaft, thereby decreasing aeration, oil temperature and spin losses and not decreasing oil pressure. Additionally, the oil pan is configured to provide these benefits, whether the engine is used in a front wheel-drive or a rear wheel-drive vehicle. Specifically, the oil pan is configured to contain oil and to be mountable to the engine block and has a baffle extending transverse to the axis of rotation of the engine crankshaft when the oil pan is so mounted. The baffle is configured to partially define a first oil reservoir and a second oil reservoir, as well as an oil flow opening such that the oil reservoirs are in fluid communication with one another and are characterized by respective first and second oil levels within the pan. The second reservoir drains to the first reservoir when the engine is running and when the engine block and crankshaft are positioned on the vehicle such that the axis of rotation is tilted from horizontal. The first oil level is lower than the second oil level to avoid oil contact with the crankshaft. An internal combustion engine including the oil pan described above is also provided.

In one embodiment, the oil pan has a floor and side walls extending substantially vertically from the floor. The baffle extends substantially vertically from the floor transversely between two opposing ones of the side walls to partially define the first and second reservoirs. The floor has a first portion and a second portion and defines a step between the first and second portions. The sidewalls are configured so that the oil pan is deeper at the first portion than at the second portion. The baffle extends from the second portion.

A method of assembling engines in vehicles includes providing a first oil pan having a baffle extending from a floor of the oil pan between opposing side walls of the oil pan and configured to be transverse to the crankshaft when the oil pan is mounted to the engine. The baffle has an oil flow opening and divides the oil pan into a first reservoir and a second reservoir in communication with one another via the oil flow opening. The method includes mounting the first oil pan to a first engine, and installing the first engine with the first oil pan mounted thereto on a front wheel-drive vehicle. Further, the method may include mounting a second oil pan substantially identical to the first oil pan to a second engine substantially identical to the first engine. The second engine with the second oil pan mounted thereto is then installed on a rear wheel-drive vehicle. The oil pan manages oil level to prevent contact with the rotating crankshaft whether on an engine used in a front wheel-drive or rear wheel-drive vehicle, and even when the crankshaft is tilted with respect to horizontal when installed on a rear wheel-drive vehicle.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figures 1A, 1B:
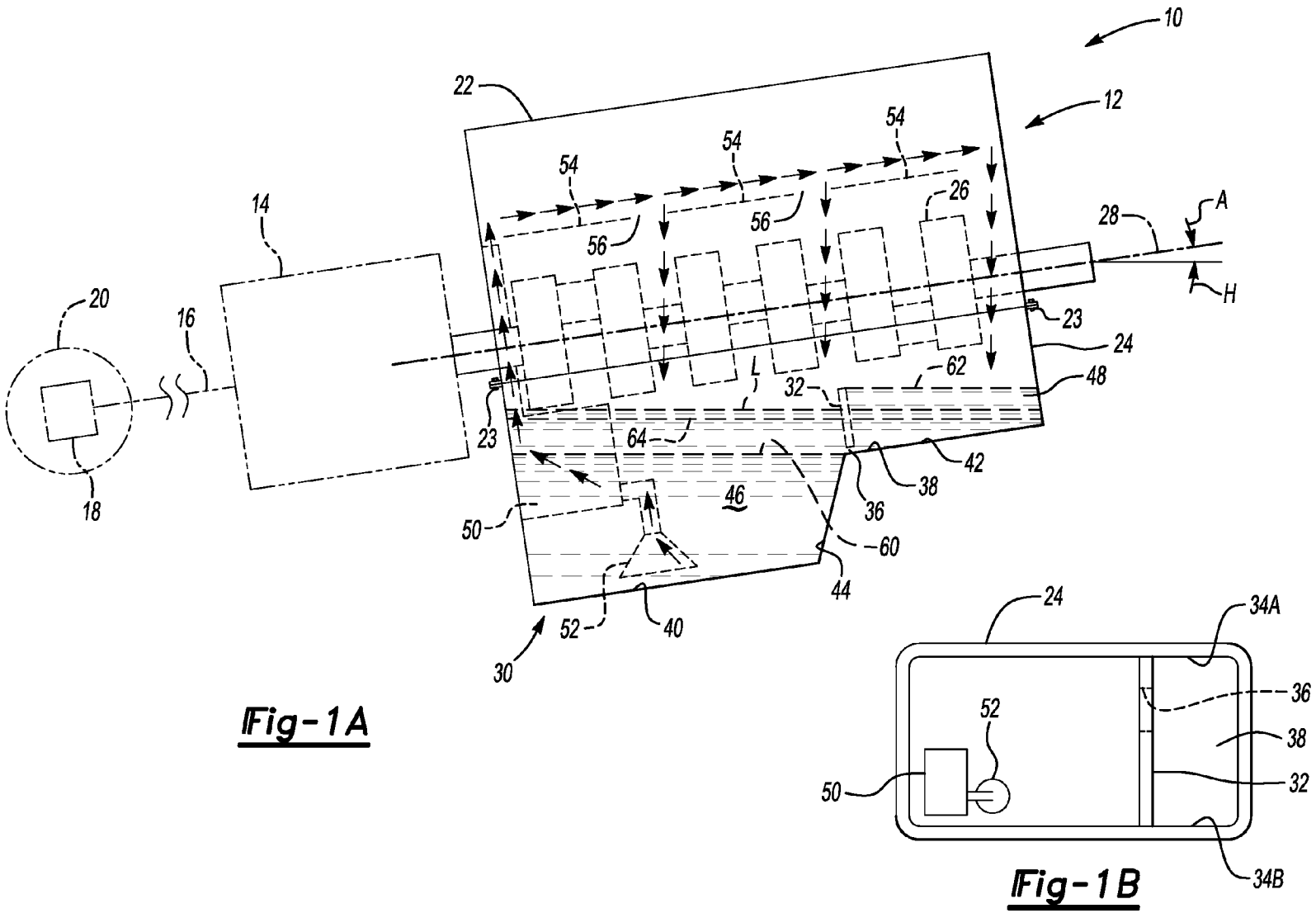
FIG. 1A is a schematic side view illustration of a rear-wheel drive vehicle having an engine with a first embodiment of an oil pan incorporating an oil management system including a transverse vertical baffle.
FIG. 1B is a schematic plan view of the oil pan with oil management system of FIG. 1A.

Referring to the drawings wherein like reference numbers refer to like components, FIG. 1A shows a vehicle 10 arranged as a rear wheel-drive vehicle having an engine 12 operatively connected with a transmission 14. The transmission 14 is operatively connected through a driveshaft 16 and differential mechanism 18 to left and right rear wheels 20 (only right rear wheel 20 visible in side view and not to scale).

The engine 12 includes an engine block 22 to which an oil pan 24 is mounted. The engine block 22 supports a crankshaft 26 which rotates about an axis of rotation 28, as is known. The oil pan 24 is mounted to the engine block 22 generally below the crankshaft 26. The oil pan 24 is a cast aluminum alloy, but may alternatively be stamped sheet metal, or any other suitably formed material.

As is typical in rear wheel-drive applications, the engine 12 is tilted with respect to horizontal in order for the transmission 14 to connect with the driveshaft 16. That is, the engine 12 is mounted to the vehicle frame (not shown) such that the axis of rotation 28 is installed at an angle A with respect to a horizontal line H generally parallel with level ground under the wheels 20. In the embodiment of FIG. 1A, angle A is six degrees; however, this embodiment is exemplary only, and the oil level management system 30 will be operable with the crankshaft 26 installed at other angles as well.

The oil pan 24 is part of an oil level management system 30 that prevents contact with or entrainment of oil within the oil pan 24 and the rotating crankshaft 26 or the windage thereof. "Windage" is air movement caused by the rotating crankshaft. Specifically, the oil management system 30 includes a baffle 32 that runs transverse to the axis of rotation 28 and is substantially vertical with respect to the horizontal line H, at least when the engine 12 is installed in a rear wheel-drive application, as in FIG. 1. Within the scope of the claimed invention, the baffle need not be completely vertical in all embodiments, but need only have a vertical component, i.e., an overall vertical rise from the floor, sufficient to affect the oil level as claimed. As discussed further below, the same oil pan 24 and engine 12 may be installed in front wheel-drive applications; however, the vertical baffle 32 affects oil level within the oil pan 24 only when the engine 12 is installed with the axis of rotation 28 at an angle A, such as in a rear wheel-drive application.

As shown in FIG. 1B, the baffle 32 runs between opposing side walls 34A, 34B of the oil pan 24, which extend substantially perpendicular from the floor 38. The baffle 32 has an oil flow opening 36 extending therethrough, just above the floor 38 of the oil pan 24. The oil flow opening 36 is a slot extending partly along the width of the floor 38. As best shown in FIG. 1A, the floor 38 has a first portion 40 and a second portion 42, with a step 44 therebetween. The stepped nature of the floor 38 causes the side walls 34A, 34B to be higher in the area of the first portion 40 than in the area of the second portion 42. This creates a first reservoir 46 above the first portion 40 within the oil pan 24 that is deeper than a second reservoir 48 above the second portion 42. The baffle 32 extends from the second portion 42.

In addition to the oil pan 24 with baffle 32, the oil level management system 30 includes an oil pump 50 and pump pickup 52 mounted to the oil pan 24 within the first reservoir 46. When the engine 12 is off, the baffle 32 has no effect on oil level, and oil is at a static oil level L that is the same in the first and second portions. During operation of the engine 12, the pump 50 is driven by the crankshaft 26, causing oil within the first reservoir 46 to be directed according to the flow path shown via arrows in FIG. 1A to lubricate and cool the rotating crankshaft 26 as well as other engine components. Thus, the first reservoir 46 is an oil pickup chamber. Internal engine structure or componentry create a channel or passage 54 with openings 56 therein, causing the oil to be distributed appropriately throughout the engine 12. As the oil is directed downward or drips downward via gravity, it collects in both the first and second reservoirs 46, 48. Under a "steady-state" operating condition (i.e., after the engine 12 has been running for a sufficient amount time, the oil level within the respective first and second reservoirs 46, 48 will establish a first oil level 60 in the first reservoir 46 and a second oil level 62 in the second reservoir 48. Oil drains from the second reservoir 48 to the first reservoir 46 through the opening 36 at a flow rate controlled by the size of the opening 36.

Because the baffle 32 creates an oil level 62 in the second reservoir 48 during steady-state operation, a portion of the total volume of the oil is temporarily retained in the second reservoir 48, and the oil level 60 within the first reservoir 46 is lower than an oil level 64 that would occur without the transverse baffle 32. Thus, the baffle acts as a dam, lowering the oil in the vicinity of the rotating crankshaft 26, decreasing or eliminating entrained air and avoiding an associated reduction in oil pressure.

Figure 2:
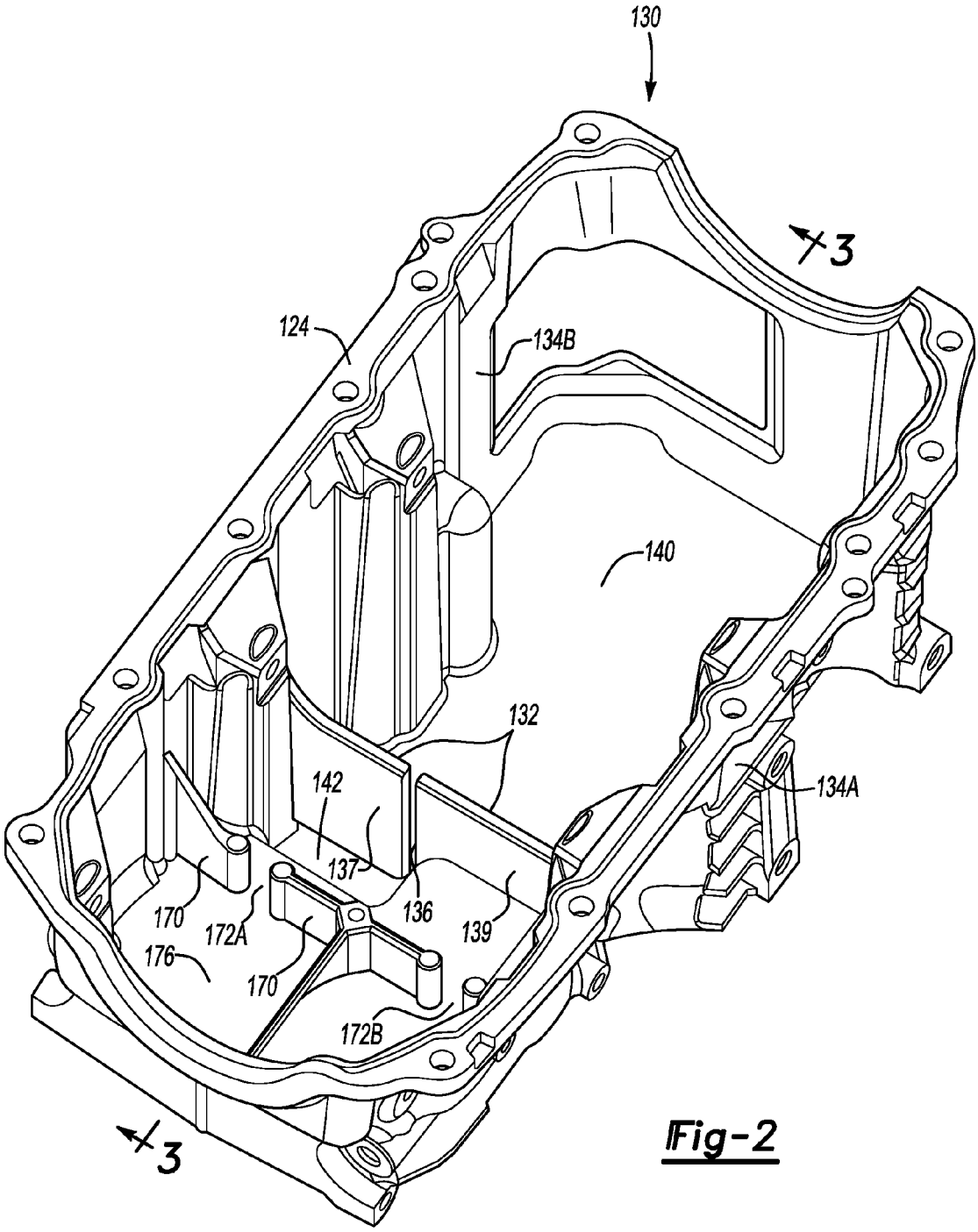
FIG. 2 is a schematic perspective illustration of a second embodiment of an oil pan incorporating an oil management system including a transverse vertical baffle.
Figure 3:
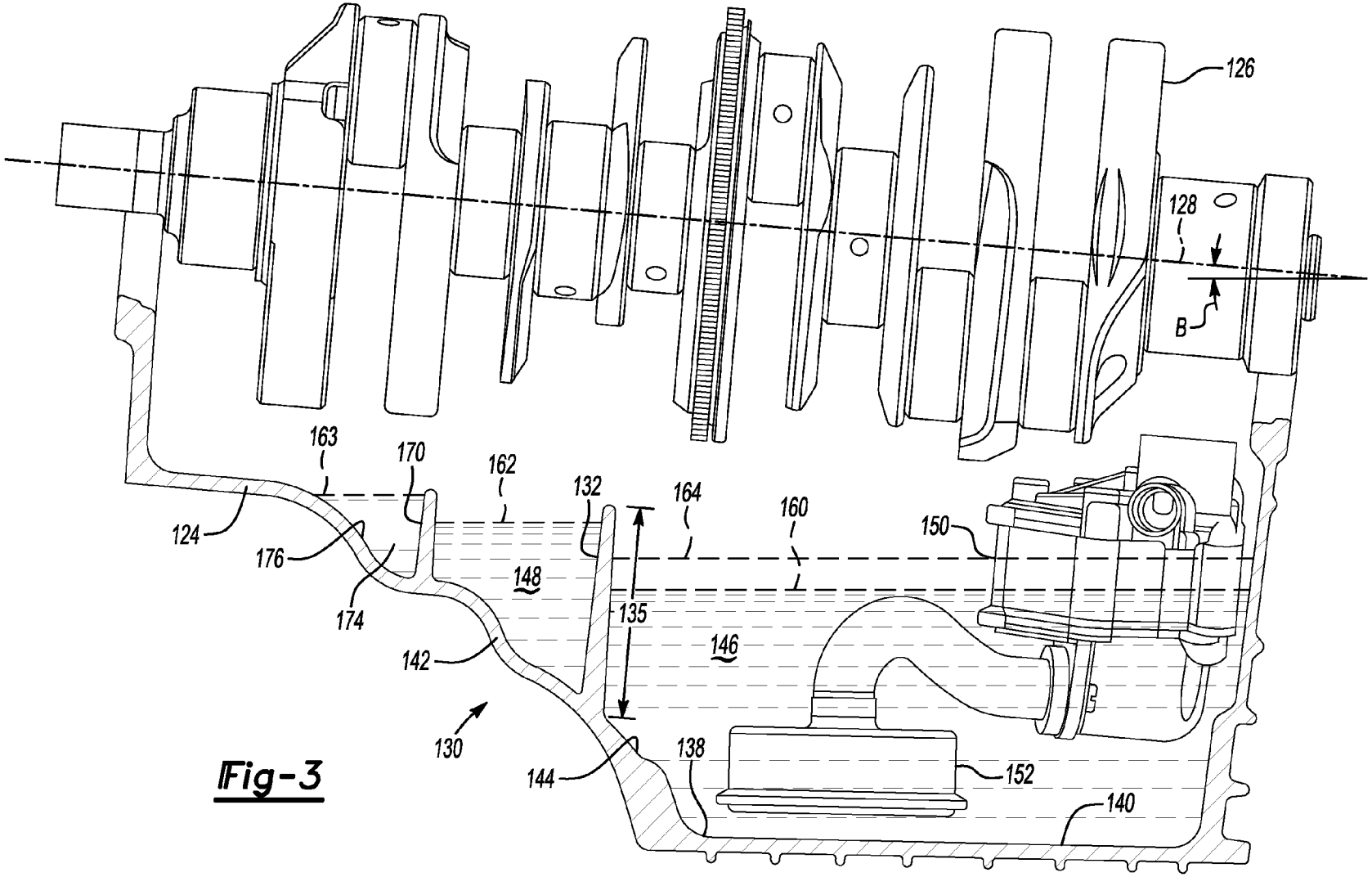
FIG. 3 is a schematic cross-sectional illustration of the oil pan of FIG. 2 with the engine crankshaft shown.

Referring to FIGS. 2 and 3, a second embodiment of an oil level management system 130 including a second embodiment of an oil pan 124 is shown. Specifically, the oil management system 130 includes a first baffle 132 running transverse to an axis of rotation 128 of an engine crankshaft 126, at least when the oil pan 124 and crankshaft 126 are installed on an engine in a rear wheel-drive application, such as in FIG. 1. The same oil pan 124 may be installed on the same engine in front wheel-drive applications; however, the baffle 132 affects the oil level when installed in a rear wheel-drive application with the axis of rotation 128 installed at an angle, such as angle B. The oil level management system 130 further includes a pump 150 and pump pickup 152, similar in function and operation to pump 50 and pickup 52.

As shown in FIG. 2, the baffle 132 runs between opposing side walls 134A, 134B of the oil pan 124. The baffle 132 has an oil flow opening 136 extending therethrough along the height 135 thereof, just above the floor 138 of the oil pan 124. The oil flow opening 136 divides the first baffle 132 into a first baffle portion 137 and a second baffle portion 139. As shown in FIG. 3, the floor 138 has a first portion 140 and a second portion 142, with a step 144 therebetween. The baffle 132 extends from the second portion 142. The stepped nature of the floor 138 causes the side walls 134A, 134B to be higher in the area of the first portion 140 than in the area of the second portion 142. During engine operation, oil is distributed via the pickup 152 and pump 150 throughout the engine (not shown) to which the oil pan 124 is mounted, and then drains back into the pan 124. This creates a first reservoir 146 above the first portion 140 within the oil pan 124 that is deeper than a second reservoir 148 above the second portion 142. A second baffle 170 with multiple oil flow openings 172A, 172B therein creates a third reservoir 174 above a third portion 176 of the floor 138. Oil in the third reservoir 174 drains through oil flow openings 172A, 172B to the second reservoir 148. Oil in the second reservoir 148 in turn drains through the oil flow opening 136 to the first reservoir 146. Oil is at a first oil level 160 in the first reservoir 146, a higher second oil level 162 in the second reservoir 148, and an even higher third oil level 163 in the third reservoir 174. Oil level 160 is lower than an oil level 164 that would exist during engine operation if the pan 124 did not have baffles 132, 170, decreasing aeration, loss of oil pressure, and spin losses. Thus, the oil pan 124 is appropriate for use on a rear wheel-drive vehicle, as in FIG. 1A, with an engine installed such that the crankshaft 126 is at an angle with respect to horizontal.

Figure 4:
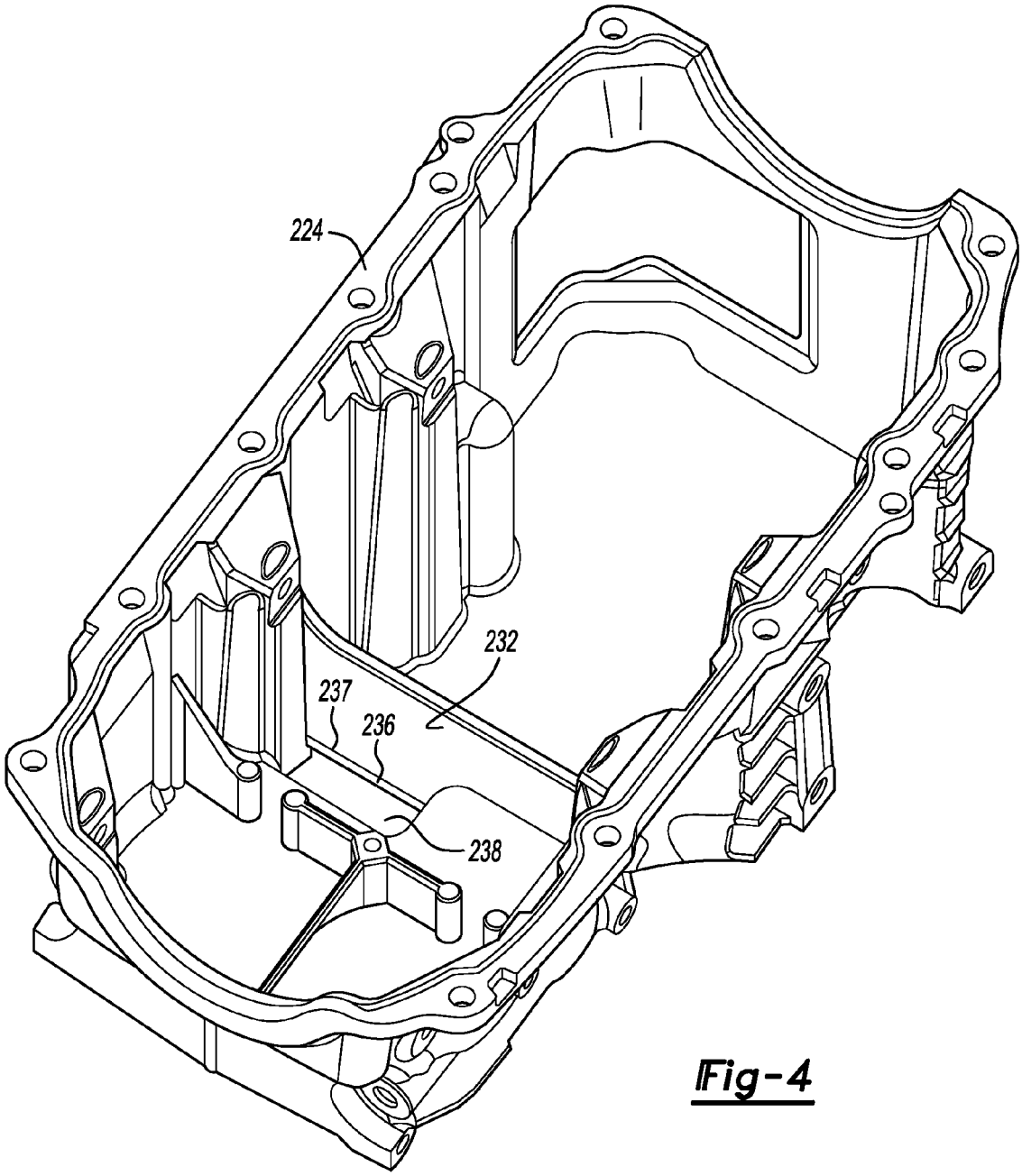
FIG. 4 is a schematic perspective illustration of a third embodiment of an oil pan incorporating an oil management system including a transverse vertical baffle.

Referring to FIG. 4, a third embodiment of an oil pan 224 is identical in all aspects to oil pan 124 except that first baffle 132 is replaced with first baffle 232. First baffle 232 has an oil flow opening 236 in the form of a gap between a lower edge 237 of the baffle 232 and the floor 238. With the baffle 232 and opening 236 functioning identically to baffle 132 and opening 136, the oil pan 224, when used as part of an oil level management system, will result in the varied oil levels 163, 162 and 160 shown in FIG. 3 when connected with an engine having crankshaft 126 and with oil pickup 152 and pump 150 functioning to distribute the oil. Thus, the oil pan 224 is appropriate for use on a rear wheel-drive vehicle, such as in FIG. 1A, with an engine installed such that the crankshaft is at an angle with respect to horizontal.

Figure 5:
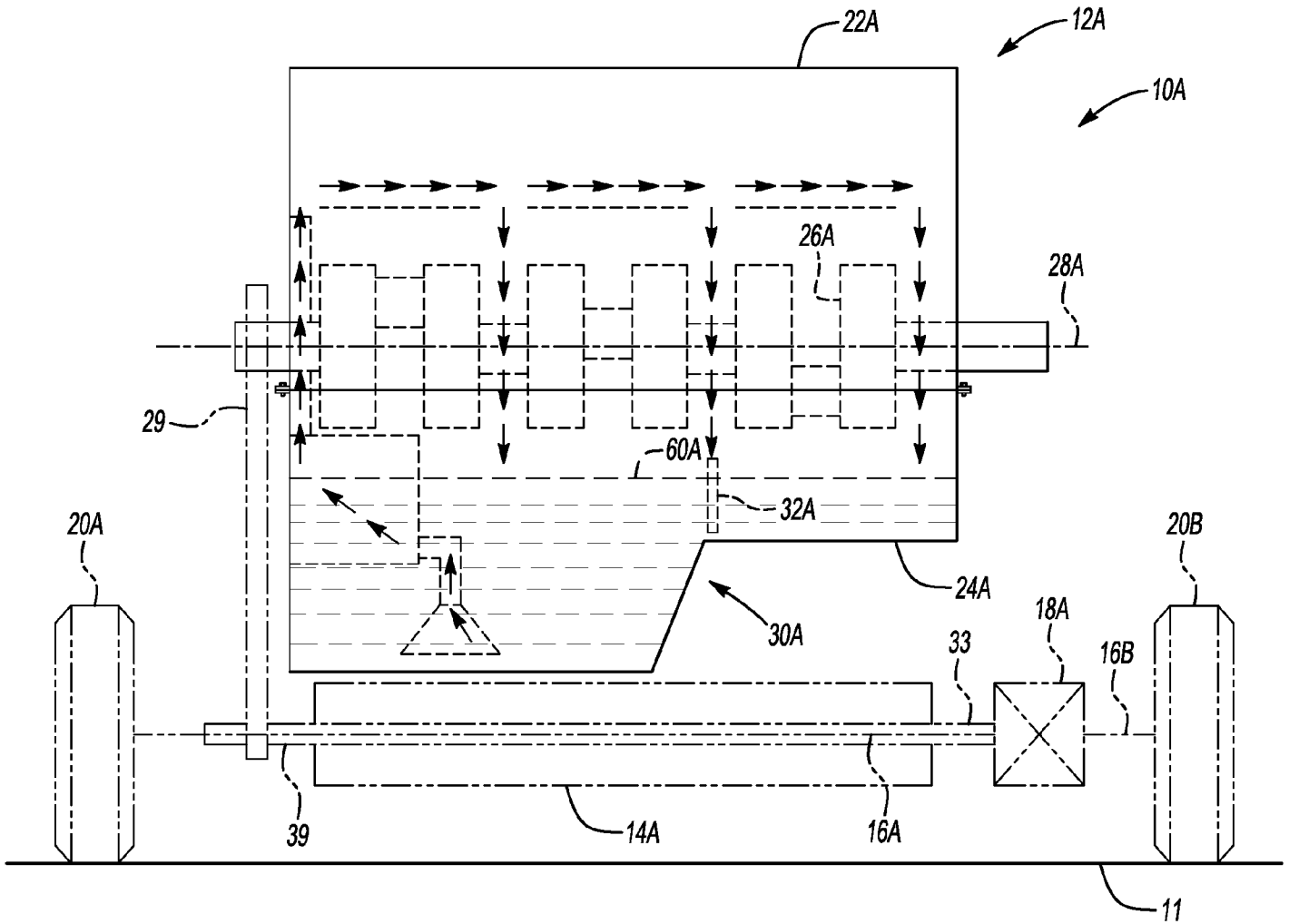
FIG. 5 is a schematic front view illustration of a front wheel-drive vehicle having an engine and oil pan identical to those of FIGS. 1A-1B.

Referring to FIG. 5, an oil pan 24A in an oil management system 30A substantially identical to oil pan 24 and oil management system 30 of FIG. 1A are used with an engine 12A with engine block 22A, and crankshaft 26A, substantially identical to engine 12, engine block 22 and crankshaft 26, and installed in a front wheel-drive vehicle 10A. The engine 12A is positioned with the crankshaft 26A running transverse with respect to the vehicle 10A, and installed such that the axis of rotation 28A of the crankshaft 26A is substantially horizontal with the level ground 11. The crankshaft 26A is connected via a rotating device 29, such as a chain or belt, to an input member 39 of a transmission 14A. Torque is transferred to an output member 33, and then distributed through a differential 18A to wheel shafts 16A, 16B to the front wheels 20A, 20B (not to scale). Wheel shaft 16A extends concentrically within input member 39. As shown in FIG. 5, the baffle 32A does not cause differing oil levels within the oil pan 24A when the engine 12A is installed with the axis of rotation 28A of the crankshaft 26A generally horizontal. Instead, the oil level 60A is the same throughout. The design of the oil pan 24, 24A, and specifically the baffle 32, 32A allows the same engine 12, 12A and oil pan 24, 24A to be used in both front wheel-drive and rear wheel-drive applications, because the oil level resulting in the oil pan 24 or 24A when the engine 12 or 12A is installed at an angle with respect to horizontal in the rear wheel-drive application will be managed via the baffle 32 or 32A and opening 26 or 26A to prevent air entrainment and spin losses.

Accordingly, a method of assembling engines in vehicles discussed with respect to the vehicle 10 of FIGS. 1A, 1B, includes providing a first oil pan 24 having a baffle 32 extending from a floor 38 of the oil pan 24 between opposing oil pan side walls 34A, 34B. The baffle 32 is configured to be transverse to the axis of rotation of the crankshaft 28 when the oil pan 24 is mounted to the engine 12, has an oil flow opening 36, and divides the oil pan 24 into a first reservoir 46 and a second reservoir 48 in fluid communication with one another via the opening 36.

The method includes mounting the first oil pan 24 to a first engine 12, as shown in FIG. 1A, where the oil pan 24 is mounted to the engine block 22 via bolts 23. The engine 12 is then installed on a rear wheel-drive vehicle 10. As discussed above, engines of the same type may be used in front wheel-drive applications as well. Thus, the method further includes mounting a second oil pan 24A substantially identical to oil pan 24 to a second engine 12A substantially identical to first engine 12, and installing a second engine 12A with the second oil pan 24A mounted thereto on a front wheel-drive vehicle 12A, as illustrated in FIG. 5.

While the best modes for carrying out the invention have been described in detail, those familiar with the art to which this invention relates will recognize various alternative designs and embodiments for practicing the invention within the scope of the appended claims.

The invention claimed is:

1. An oil level management system for a vehicle having an engine with an engine block and a crankshaft rotatable about an axis of rotation comprising:

an oil pan configured to contain oil and to be mountable to the engine block;

wherein the oil pan has a baffle extending transverse to the axis of rotation when the oil pan is so mounted; wherein the baffle is configured to partially define a first oil reservoir and a second oil reservoir; wherein the baffle defines an oil flow opening such that the oil reservoirs are in fluid communication with one another and are characterized by respective first and second oil levels within the pan with the second reservoir draining to the first reservoir when the engine is running and when the engine block and crankshaft are positioned on the vehicle with the axis of rotation tilted from horizontal; wherein the first oil level is lower than the second oil level to avoid oil contact with the crankshaft;

wherein the oil pan has a floor and opposing side walls extending substantially vertically therefrom; wherein the baffle extends from and spans transversely between the opposing side walls to partially define the first and second reservoirs; and wherein the baffle is spaced above the floor to define the oil flow opening between the baffle and the floor.

2. The oil level management system of claim 1;

wherein the opposing side walls are higher at the first reservoir than at the second reservoir with the first reservoir thereby being deeper than the second reservoir.

3. The oil level management system of claim 1, wherein the first reservoir is an oil pickup chamber for distribution of oil in the engine.

4. The oil level management system of claim 1, wherein the oil pan is one of a cast aluminum alloy, a stamped metal, and a fabricated metal.

5. The oil level management system of claim 1 in combination with the vehicle, wherein the vehicle is a rear wheel-drive vehicle.

6. The oil level management system of claim 1, wherein the baffle is a first baffle and the oil flow opening is a first oil flow opening; wherein the oil pan further includes a second baffle spaced from the first baffle and extending transverse to the axis of rotation opposite the first baffle from the first reservoir and defining a second oil flow opening to allow oil flow therethrough to the second reservoir.

7. An internal combustion engine comprising:

an oil pan that has a floor and side walls extending from the floor; wherein the oil pan has a baffle extending from and spanning transversely between two opposing ones of the side walls to partially define a first reservoir and a second reservoir within the oil pan and to define an oil flow opening above the floor, below the baffle, and between the reservoirs; wherein the floor has a first portion and a second portion and defines a step between the first and second portions; and wherein the sidewalls are configured so that the oil pan is deeper at the first portion than at the second portion.

8. The internal combustion engine of claim 7, wherein the first reservoir is an oil pickup chamber for distribution of oil in the engine.

9. The internal combustion engine of claim 7, further comprising:

an engine block; and a rotatable crankshaft with an axis of rotation and supported by the engine block;

wherein the oil pan is mounted to the engine block with the baffle transverse to the axis of rotation.

10. The internal combustion engine of claim 9, wherein the baffle is a first baffle and the oil flow opening is a first oil flow opening; and wherein the oil pan further includes a second baffle spaced from the first baffle and extending transverse to the axis of rotation opposite the first baffle from the first reservoir and defining a second oil flow opening to allow oil flow therethrough to the second reservoir.

11. A method of assembling engines in vehicles, wherein each engine has a crankshaft, comprising:

providing a first oil pan having a baffle spanning between opposing side walls of the oil pan and configured to be transverse to the crankshaft when the oil pan is mounted to the engine; wherein the baffle is spaced above the floor to define an oil flow opening between the baffle and the floor; wherein the baffle divides the oil pan into a first reservoir and a second reservoir in communication with one another via the oil flow opening;

mounting the first oil pan to a first engine; and installing the first engine with the first oil pan mounted thereto in a front wheel-drive vehicle.

12. The method of claim 11, further comprising:

mounting a second oil pan substantially identical to the first oil pan to a second engine substantially identical to the first engine; and installing the second engine with the second oil pan mounted thereto in a rear wheel-drive vehicle.

13. The method of claim 12, wherein the crankshaft of the first engine is substantially horizontal and runs transversely with respect to the first vehicle when installed on the first vehicle; and wherein the crankshaft of the second engine is tilted relative to horizontal and runs longitudinally with respect to the second vehicle when installed on the second vehicle.

* * * * *